US006377153B1

(12) United States Patent
Yamanaka et al.

(10) Patent No.: US 6,377,153 B1
(45) Date of Patent: Apr. 23, 2002

(54) TRANSFORMER APPARATUS FOR USE IN INSULATED SWITCHING POWER SUPPLY APPARATUS WITH REDUCTION OF SWITCHING NOISE

(75) Inventors: Haruhiko Yamanaka; Hideki Wakamatsu, both of Hyogo (JP)

(73) Assignee: Agilent Technologies, Inc., Loveland, CO (US)

( * ) Notice: Subject to any disclaimer, the term of this patent is extended or adjusted under 35 U.S.C. 154(b) by 0 days.

(21) Appl. No.: 09/652,372

(22) Filed: Aug. 30, 2000

(51) Int. Cl.[7] ..... H01F 27/28; H01F 27/36
(52) U.S. Cl. ..... 336/84 R; 336/182; 336/183
(58) Field of Search ..... 336/223, 84 R, 336/84 C, 182, 183, 225, 229, 90

(56) References Cited

U.S. PATENT DOCUMENTS 4,459,576 A * 7/1984 Fox et al. ..... 336/84 C
5,322,971 A * 6/1994 Owen ..... 174/50
5,831,847 A * 11/1998 Love ..... 363/141
5,990,775 A * 11/1999 Inui et al. ..... 336/84 C

* cited by examiner

*Primary Examiner*—Anh Mai

(57) ABSTRACT

A transformer apparatus which can reduce a switching noise current flowing between a primary side ground and a secondary side ground is provided. The transformer apparatus includes a first core having a first primary winding wound around the first core, and second core having the substantially same structure as that of the first core, and having a second primary winding wound around the second core. The second primary winding is connected in parallel to the first primary winding. The transformer apparatus further includes a third core having a secondary winding around the third core, which is entirely and electrostatically shielded by a first conductor housing. The third core is arranged so as to be sandwiched between the first and second cores via first and second electrostatically shielding disks electrically connected to a second conductor housing. The first, second and third cores are electrically connected by the second conductor housing operating as one-turn winding, and are electrostatically and magnetically shielded from the outside of the transformer apparatus by the second conductor housing.

3 Claims, 10 Drawing Sheets

FIG. 2A
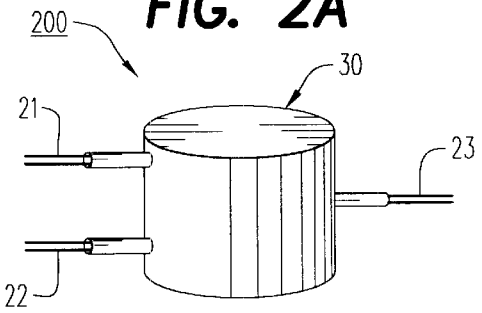
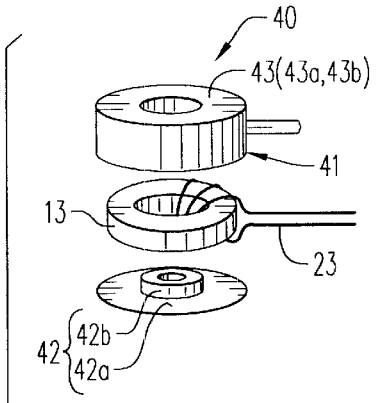
FIG. 2C
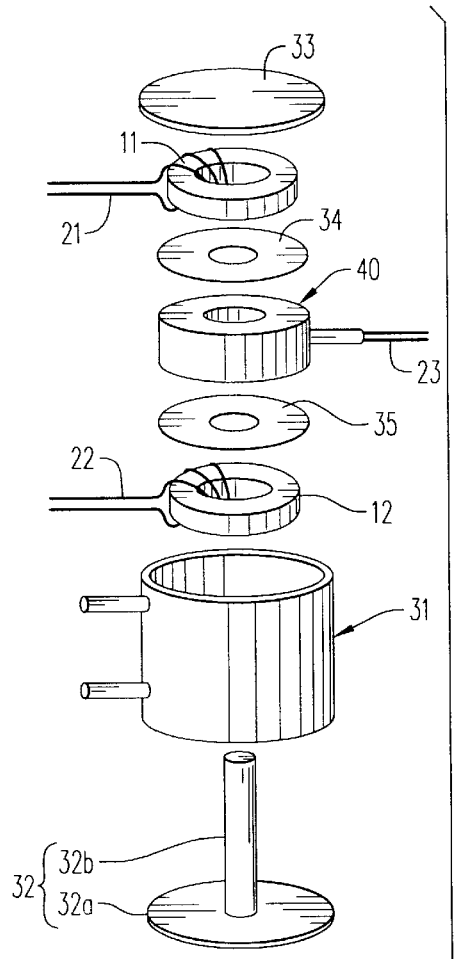
FIG. 2B

+

=

TRANSFORMER APPARATUS FOR USE IN INSULATED SWITCHING POWER SUPPLY APPARATUS WITH REDUCTION OF SWITCHING NOISE

BACKGROUND OF THE INVENTION

1. Field of the Invention

The present invention relates to a transformer apparatus, and in particular, to a transformer apparatus for use in an insulated switching power supply apparatus for the purpose of reduction of switching noise flowing between a primarily side ground and a secondary side ground of the transformer apparatus.

2. Description of the Related Art

First of all, an impedance meter is cited as an conventional example using an insulated switching power supply apparatus, and then, the insulated switching power supply apparatus, in particular, a performance required for a transformer apparatus used therefor will be explained below. FIG. 7 is a circuit diagram showing an example of an impedance meter when one end of a test element is grounded, that is, in one-line grounded measurement. In the arrangement shown in FIG. 7, an ampere meter 73 has a ground point common to a ground point of a test element 70. However, it is necessary to separate an alternating current signal source 71 and a voltmeter 72 from the ground point of the test element 70. For this reason, an electric power must be supplied to the alternating current signal source 71 and the voltmeter 72 from the insulated switching power supply apparatus of DC-DC converter.

In the case of supplying an electric power to the alternating current signal source 71 and the voltmeter 72 from an insulated DC-DC converter 100, this leads to such a problem as a switching noise of the insulated DC-DC converter 100. As shown in FIG. 8, when a switching noise current flows between a primary side ground and a secondary side ground of the DC-DC converter 100, the switching noise current flows into the ampere meter 73 of the impedance meter, and then, this interferes an impedance measurement.

A method of evaluating the switching noise current flowing into the ampere meter 73 to give a quantitative index is shown in FIG. 9, paying attention to a performance of a single transformer apparatus, which is a part for determining a magnitude of switching noise. A transformer apparatus is connected in a manner as shown in FIG. 9, and then, an electrostatic capacitance value C is measured by using the following equation:

$$C=(I/V)\times(1/j\omega) \quad (1)$$

where I denotes a value measured by the ampere meter 93;

V denotes a value measured by the voltmeter 92; and

ω denotes an angular frequency (=2πf), where f denotes a signal frequency of a signal source 91.

The factor when a current flows between the primary side ground and the secondary side ground is not always electrostatic coupling between the primary side ground and the secondary side ground, and in many cases, it is due to a leakage magnetic flux. In any case, when a voltage of the primary side exciting the transformer apparatus is set to a constant value, there are many cases where a current flowing between the primary and secondary sides is proportional to the frequency, and then, it is convenient to express the amplitude of the noise current as an electrostatic capacitance value.

FIGS. 10 and 11 show a structure of a conventional transformer apparatus. Referring to FIGS. 10 and 11, coaxial cables are utilized as lead wires of a primary winding 121 and a secondary winding 122 so as not to generate a magnetic flux outside the transformer apparatus. These primary winding 121 and secondary winding 122 are subjected to electrostatic shield 115, and then, respective electrostatic capacitances C10 between the primary winding 121 and a secondary side ground 132 and between the secondary winding 122 and a primary side ground 131 are small. Accordingly, this is not a principal factor of switching noise current flowing via the primary side ground and the secondary side ground (See FIG. 12).

The problem is leakage magnetic fluxes 141 and 142 existing outside a core 110. A leakage magnetic flux crossing across a space is classified into two cases as shown in FIG. 13, that is, an inside of the transformer apparatus and an outside thereof. In the transformer apparatus, the leakage magnetic flux 142 crosses across the space formed by the primary side ground and the secondary side ground so as to generate an electromotive force, and then, a switching noise current flows though the electrostatic capacitance between the primary side ground and the secondary side ground. Moreover, it is possible to cancel the generated electromotive force depending upon a shape of the primary side ground or the secondary side ground, and a position of ground lead wire. However, in the conventional transformer apparatus, it is difficult to find out the optimal shape and position of the lead wire, and also, it is difficult to obtain a geometric reproducibility. Therefore, canceling effect by this method is low. On the other hand, on the outside of the transformer apparatus, the leakage magnetic flux 141 crosses across the space formed by the lead wire of the primary side ground, the lead wire of the secondary side ground and an ampere meter connecting both the grounds so as to generate an electromotive force, and this becomes a factor of generating a switching noise current.

When the electrostatic capacitance value C is measured according to the above method shown in FIG. 9, in the conventional transformer apparatus, the limit of electrostatic capacitance is about 200 fF. An influence will be described when the aforesaid conventional transformer apparatus is utilized for the DC-DC converter 100 of the impedance meter shown in FIG. 8. Assuming that the switching frequency of the DC-DC converter 100 is set to 200 kHz, and the voltage of the switching frequency component of a primary side voltage exciting the transformer apparatus is set as 12 Vrms, then a switching noise current flowing through the ampere meter shown in FIG. 8 is obtained by the following equation:

$$12\text{Vrms}\times(2\times\pi\times200\text{kHz}\times200\text{fF})\approx3\mu\text{Arms} \quad (2).$$

In the case of measuring a 100 kΩ resistance at a 100 mVrms signal by the impedance meter, a measurement signal flowing through the ampere meter 73 becomes 1 μArms. Therefore, the above switching noise current of 3 μArms is larger than that of the measurement signal. For this reason, it is impossible to avoid a saturation of the ampere meter by the switching noise current.

As described above, in the DC-DC converter 100 using the conventional transformer apparatus, a switching noise current generated by the DC-DC converter 100 becomes large, and then, it is difficult to high accurately measure a minute current.

SUMMARY OF THE INVENTION

An essential object of the present invention is accordingly to provide a transformer apparatus capable of reducing a switching noise current flowing between a primary side ground and a secondary side ground.

According to one aspect of the present invention, there is provided a transformer apparatus comprising:

a first core having a first primary winding wound around the first core;

a second core having a substantially same structure as that of the first core, and having a second primary winding wound around the second core, the second primary winding being connected in parallel to the first primary winding;

a first conductor housing;

a second conductor housing; and a third core having a secondary winding around the third core, the third core being entirely and electrostatically shielded by the first conductor housing, wherein the third core is arranged so as to be sandwiched between the first and second cores respectively via first and second electrostatically shielding disks electrically connected to the second conductor housing, and wherein the first, second and third cores are electrically connected by the second conductor housing operating as one-turn winding, and are electrostatically and magnetically shielded from the outside of the transformer apparatus by the second conductor housing.

Therefore, according to the present invention, in the transformer apparatus, the primary side circuit is arranged in a form of symmetrical structure, and further, three cores are electrically coupled by one-turn winding provided by the second conductor housing, and are electrostatically and magnetically shielded from the outside by the second conductor housing. Accordingly, it is possible to substantially reduce a switching noise current of the DC-DC converter 100 as the conventional transformer apparatus. Therefore, it is possible to measure a minute current in an impedance meter without any interference caused by the switching noise current, and to more accurately measure an impedance as compared with the conventional case.

According to another aspect of the present invention, there is provided a transformer apparatus comprising:

first and second transformers having a substantially same structure as each other, wherein the first transformer comprises:

a first core having a first primary winding wound around the first core;

a first conductor housing;

a second conductor housing; and a third core having a first secondary winding wound around the third core, the third core being entirely and electrostatically shielded by the first conductor housing, wherein the first and third cores are arranged via a first electrostatically shielding disk electrically connected to the second conductor housing, are electrically connected by the second conductor housing operating as one-turn winding, and are electrostatically and magnetically shielded from the outside of the transformer apparatus by the second conductor housing, wherein the second transformer comprises:

a second core having a second primary winding wound around the second core, the second primary winding being connected in parallel to the first primary winding;

a third conductor housing;

a fourth conductor housing; and a fourth core having a second secondary winding wound around the fourth core, the fourth secondary winding being connected in series to the first secondary winding, the fourth core being entirely and electrostatically shielded by the third conductor housing, and wherein the second and fourth cores are arranged via a second electrostatically shielding disk electrically connected to a fourth conductor housing, are electrically connected by the fourth conductor housing operating as one-turn winding, and are electrostatically and magnetically shielded from the outside of the transformer apparatus by the fourth conductor housing.

Therefore, according to the present invention, two transformers are used, and this leads to that these respective transformers mutually cancel the switching noise currents. Then it is possible to prevent a switching noise current from flowing outside these two transformers. Moreover, one transformer apparatus is divided into two transformers, and this leads to that the structure of the transformer apparatus becomes simpler than that of prior art, then it becomes easy to manufacture the same transformer apparatus.

In the above-mentioned transformer apparatus, the first and second transformers are preferably apposed with each other.

Therefore, according to the present invention, in addition to the above-mentioned advantageous effects, two transformers are apposed with each other on a flat substrate. This leads to that the entire height of the transformer apparatus is reduced, and it is possible to improve a degree of freedom upon mounting the transformer apparatus to various equipments.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 2A is a perspective view showing a structure of the transformer apparatus shown in FIG. 1;

FIG. 2B is an exploded perspective view showing the structure of the transformer apparatus shown in FIG. 2A;

FIG. 2C is an exploded perspective view showing a structure of a conductor housing 40 shown in FIG. 2B;

DETAILED DESCRIPTION OF THE PREFERRED EMBODIMENTS

Preferred embodiments according to the present invention will be described below with reference to the attached drawings.

Figure 1:
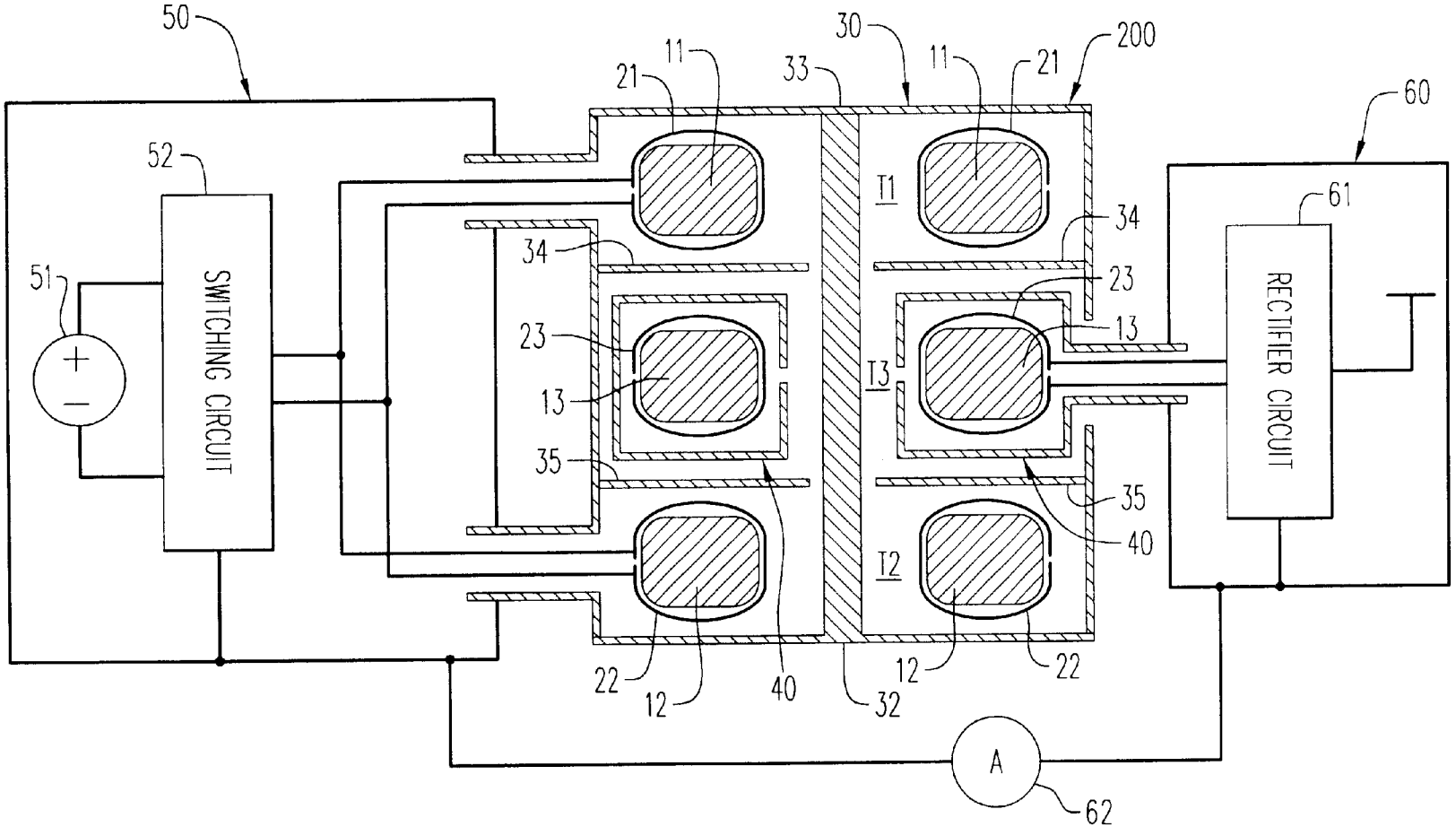
FIG. 1 shows a preferred embodiment according to the present invention, and is a view combining a cross sectional view showing a transformer apparatus for use in an insulated switching power supply apparatus, and a circuit diagram showing a configuration of peripheral circuits thereof.
Figure 3:
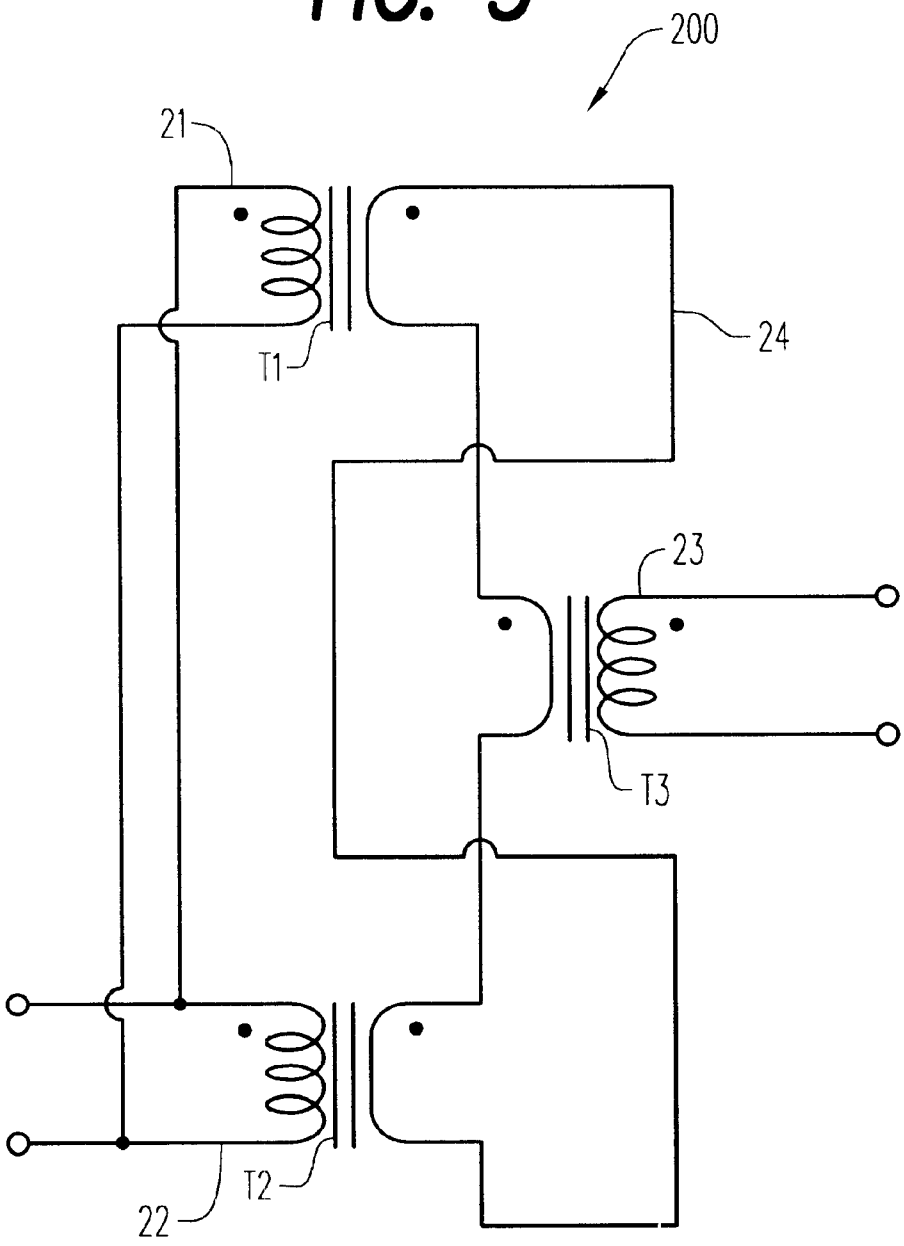
FIG. 3 is a circuit diagram showing an electrically equivalent circuit of the transformer apparatus shown in FIG. 1.

FIG. 1 shows a preferred embodiment according to the present invention, and is a view combining a cross sectional view showing a transformer apparatus for use in an insulated switching power supply apparatus, and a circuit diagram showing a configuration of peripheral circuits thereof. FIG. 2A is a perspective view showing a structure of the transformer apparatus shown in FIG. 1, FIG. 2B is an exploded perspective view showing the structure of the transformer apparatus shown in FIG. 2A, and FIG. 2C is an exploded perspective view showing a structure of a conductor housing 40 shown in FIG. 2B. Further, FIG. 3 is a circuit diagram showing an electrically equivalent circuit of the transformer apparatus shown in FIG. 1.

According to the present preferred embodiment, the transformer apparatus 200 comprises (a) a core 11 around which a primary winding 21 is wound, (b) a core 12 having the substantially same structure as that of the core 11, where a primary winding 22 connected in parallel to the primary winding 21 is wound around the core 12, and (c) a core 13 which is entirely and electrostatically shielded by a conductor housing 40 from the outside of the core 13, where a secondary winding 23 is wound around the core 13.

Further, the core 13 is arranged so as to be sandwiched between a pair of cores 11 and 12, respectively, via electrostatically shielding disks 34 and 35 which are electrically connected to the conductor housing 30. These cores 11, 12 and 13 are electrically connected by the conductor housing 30 which is operated as a one-turn winding 24 (See equivalent circuit shown in FIG. 3), and these three cores 11, 12 and 13 are electrostatically shielded from the outside thereof by the conductor housing 30. In this case, preferably, each of these cores 11, 12 and 13 is comprised of a circular-ring-shaped troidal core as shown in FIGS. 1, 2A, 2B and 2C.

A structure of the transformer apparatus 200 of the present preferred embodiment will be described below in detail with reference to FIGS. 1 to 3.

Referring to FIG. 1, a direct current power supply 51 and a switching circuit 52 comprises a shield housing 50 of a primary side circuit. The switching circuit 52 switches a predetermined direct current voltage outputted from the direct current power supply 51 with a predetermined switching frequency so as to generate a pulse voltage signal, and then, outputs the resulting switched voltage to the primary windings 21 and 22 of the transformer apparatus 200. The transformer apparatus 200 converts a voltage of the pulse voltage signal applied to the primary windings 21 and 22 into a predetermined voltage, and thereafter, outputs the voltage-converted pulse voltage signal from the secondary winding 23 to a rectifier circuit 61 provided in a shield housing 60 of a secondary side circuit. The rectifier circuit 61 rectifies the pulse voltage signal thus inputted so that the pulse voltage signal is converted into a predetermined direct current voltage, and then, the rectifier circuit 61 outputs the same resulting direct current voltage.

Figure 4A:
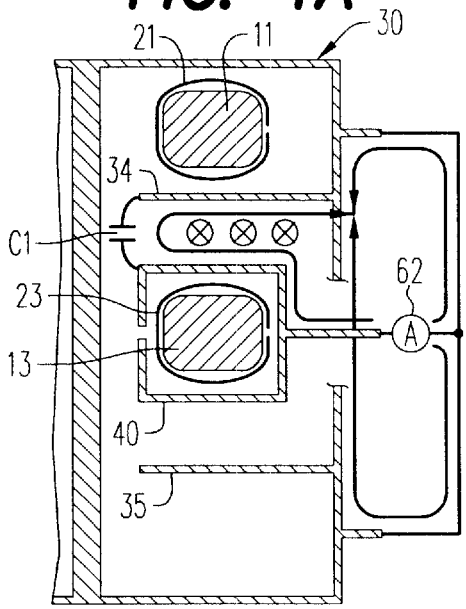
FIGS. 4A, 4B and 4C are cross sectional views and circuit diagrams, showing a cancellation of currents by a leakage magnetic flux in the transformer apparatus shown in FIG. 1.
Figure 4B:
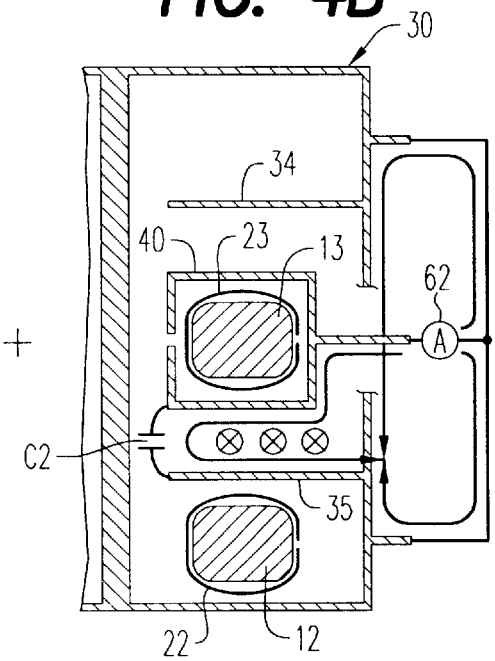
Figure 4C:
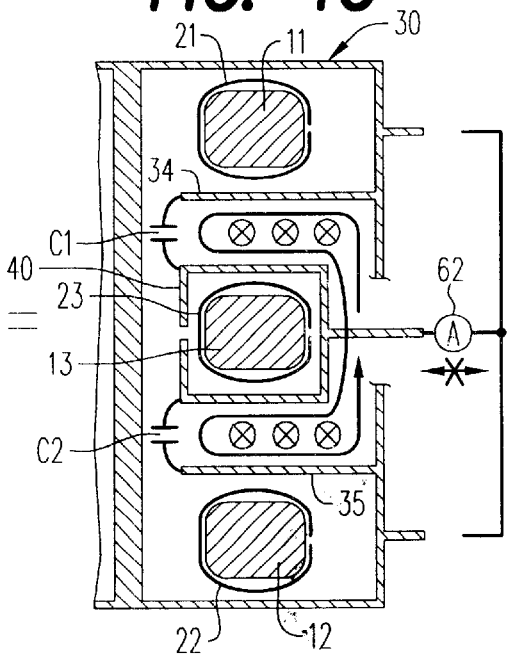

In the transformer apparatus 200, two cores 11 and 12, around which the primary windings 21 and 22 are respectively wound, are used for a primary side circuit. On the other hand, the core 13, around which the secondary winding 23 is wound, is used for a secondary side, and further, is electrostatically shielded by a conductor housing 40 made of a metallic conductive material. In this case, the conductor housing 40 is comprised of a conductor cylinder 41, a conductor housing member 43 which is mounted on the top surface of the conductor cylinder 41, and a conductor housing member 42 which is mounted on the bottom surface of the conductor cylinder 41. In this case, the conductor housing member 42 is comprised of a conductor disk 42*a*, and a conductor cylinder 42*b* which is projected from the central portion of the conductor disk 42 so as to penetrate through a central hole of the core 13, and these conductor disk 42*a* and conductor cylinder 42*b* are integrally formed. Moreover, the conductor housing member 43 has a structure similar to that of the conductor housing member 42, and is comprised of a conductor disk 43*a*, and a conductor cylinder 43*b* which is projected from the central portion of the conductor disk 43 so as to penetrate through a central hole of the core 13, and further, these conductor disk 43*a* and conductor cylinder 43*b* are integrally formed. In this case, each of the conductor cylinder 42*b* and the conductor cylinder 43*b* has such an axial length that the top end of the conductor cylinder 42*b* and the bottom end of the conductor cylinder 43*b* do not contact with each other, as shown in FIGS. 4A, 4B and 4C, upon mounting the conductor housing members 42 and 43 onto the conductor cylinder 41.

In the manner as described above, the secondary side core 13 electrostatically shielded is arranged so as to be sandwiched between the primary side pair of cores 11 and 12 respectively via the electrostatically shielding disk 34 and 35, and then, these cores 11, 12 and 13 are entirely covered with the conductor housing 30 having a conductor column 32*b* and a cylinder-shaped metallic conductor. In this case, the electrostatically shielding disks 34 and 35 are electrically connected to the conductor housing 30, as shown in FIG. 1. Moreover, the conductor housing 30 is comprised of a conductor cylinder 31, a conductor disk 33 arranged on the top surface of the conductor cylinder 31, and a conductor housing member 32 arranged on a lower surface of the conductor cylinder 31. In this case, the conductor housing member 32 is comprised of a conductor disk 32*a*, and the conductor column 32*b* which is projected from the central portion of the conductor disk 32*a* so as to penetrate through a central hole of the cores 11, 12 and 13, and further, these conductor disk 32*a* and conductor column 32*b* are integrally formed. The conductor column 32*b* penetrates through respective central holes of the core 12, the electrostatically shielding disk 35, the conductor housing 40, the electrostatically shielding disk 34 and the core 11, and then, the top surface of the conductor column 32*b* contacts with the conductor disk 33 so as to be electrically connected with the conductor disk 33. However, the conductor column 32*b* has no contact with the conductor housing 40 and the electrostatically shielding disks 34 and 35 so as not to be electrically connected with the conductor housing 40 and the electrostatically shielding disks 34 and 35.

The conductor housing 30 includes the conductor column 32*b* which is a column-shaped metallic conductor, and then, as shown in the electrically equivalent circuit of FIG. 3, the conductor housing 30 operates as a one-turn winding 24 so as to electromagnetically couple the primary windings 21 and 22 with the secondary winding 23. In other words, in the conductor housing 30, a closed circuit is made by a circuit path of the conductor column 32*b*→the conductor disk 33→the conductor cylinder 31→the conductor disk 32*a*→the conductor column 32*b*, and then, the closed circuit constitutes the one-turn winding 24. Each of the electrostatically shielding disks 34 and 35 operate as a metallic disk for electrostatically shielding between the primary windings 21 and 22 and the secondary side ground. In this case, the conductor housing 30 functions as a primary side ground, and the conductor housing 40, which is a electrostatic shield covering the secondary side core 12, functions as a secondary side ground.

The transformer apparatus 200 constructed as described above comprises three transformers T1, T2 and T3, as shown in the electrically equivalent circuit of FIG. 3. One of the pair of primary windings 21 and 22 connected in parallel to each other, that is, the primary winding 21 functions as a primary winding of the transformer T1, and the primary winding 22 functions as a primary winding of the transformer T2. On the other hand, the secondary winding 23 functions as a secondary winding of the transformer T3. One-turn winding 24, in which the conductor housing 30 operates in fact, function as a secondary winding of the transformers T1 and T2, and functions as a primary winding of the transformer T3. With the above-mentioned electric configuration, in the transformer apparatus 200, the primary windings 21 and 22 and the secondary winding 23 are electromagnetically coupled with each other.

FIGS. 4A, 4B and 4C show an influence by a leakage magnetic flux generated in the transformer apparatus 200 having the above-mentioned configuration of the present preferred embodiment.

Figure 8:
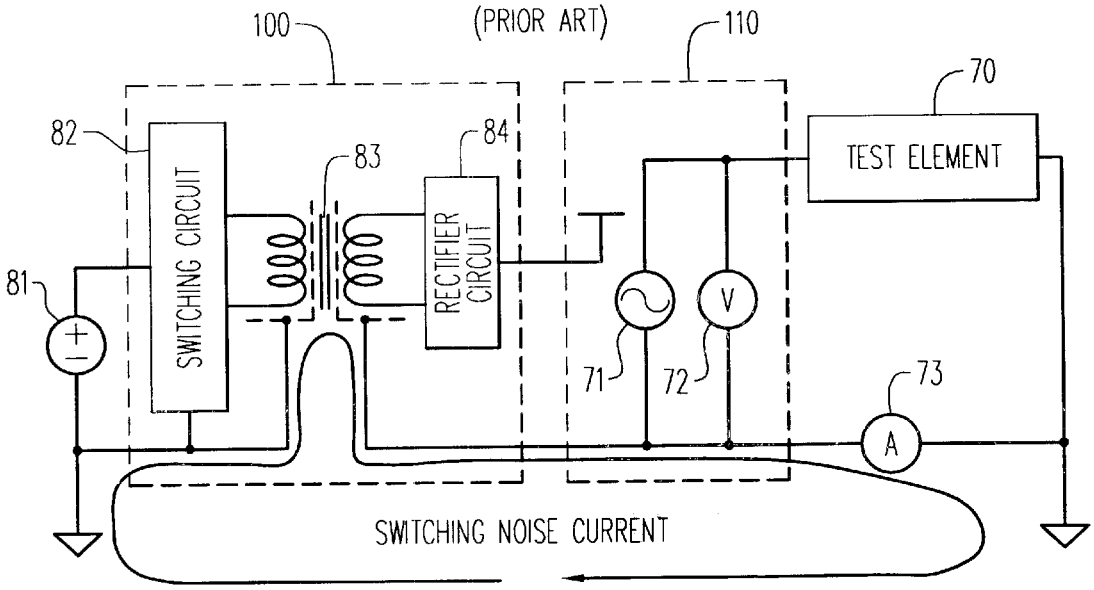
FIG. 8 (PRIOR ART)
FIG. 8 is a circuit diagram showing a mechanism in which a switching noise influences a current measurement in a conventional insulated DC-DC converter 100 and a floating circuit 110 connected thereto.

Referring to FIGS. 4A, 4B and 4C, in order to simplify an illustration, a lead portion of each winding is omitted in FIGS., and respective lead portions of the primary and secondary side grounds are illustrated so as to be collected on one side of the transformer apparatus 200. Since the troidal core 11, 12 and 13 are used, a leakage magnetic flux generated within the transformer apparatus 200 may be considered in only coaxial direction. As shown in the prior art of FIG. 8, when the primary side core 11 is one, a switching noise current flows by a leakage magnetic flux between the primary side ground and the secondary side ground. However, when the secondary side core 13 is arranged in a form of symmetrical structure so as to be sandwiched between two primary side cores 11 and 12, as shown in FIG. 4A, 4B and 4C, switching noise currents flowing between the primary side ground and the secondary side ground can be canceled with each other. Since the cylindrical transformer apparatus 200 has a structure which is easy to be subjected to precise machining by a machine tool such as a turning machine (lathe) or the like, a high cancellation effect can be obtained. As a result, a switching noise current between the primary side ground and the secondary side ground is minute. In the transformer apparatus 200, a current generated by a leakage magnetic flux remains, however, there is no influence outside the transformer apparatus 200.

Moreover, the transformer apparatus 200 is entirely covered by the conductor housing 30 which is a cylinder-shaped metallic conductor, so that no magnetic flux is generated outside the transformer apparatus 200. Accordingly, no interlinkage magnetic flux is generated in a space formed by the primary side ground and the secondary side ground existing outside the transformer apparatus 200, and this leads to no generation of switching noise current.

As described above, according to the present preferred embodiment, in the transformer apparatus, the primary side circuit is arranged in a form of symmetrical structure, and further, three cores 11, 12 and 13 are electrically coupled by the one-turn winding 24 comprising the conductor housing 30, and are electrostatically and magnetically shielded by the conductor housing 30. Accordingly, it is possible to substantially reduce the switching noise current of the DC-DC converter 100 as the conventional transformer apparatus. Thus, it is possible to measure a minute current in an impedance meter without any interference caused by the switching noise current, and to more accurately measure an impedance as compared with the conventional case.

Figure 5:
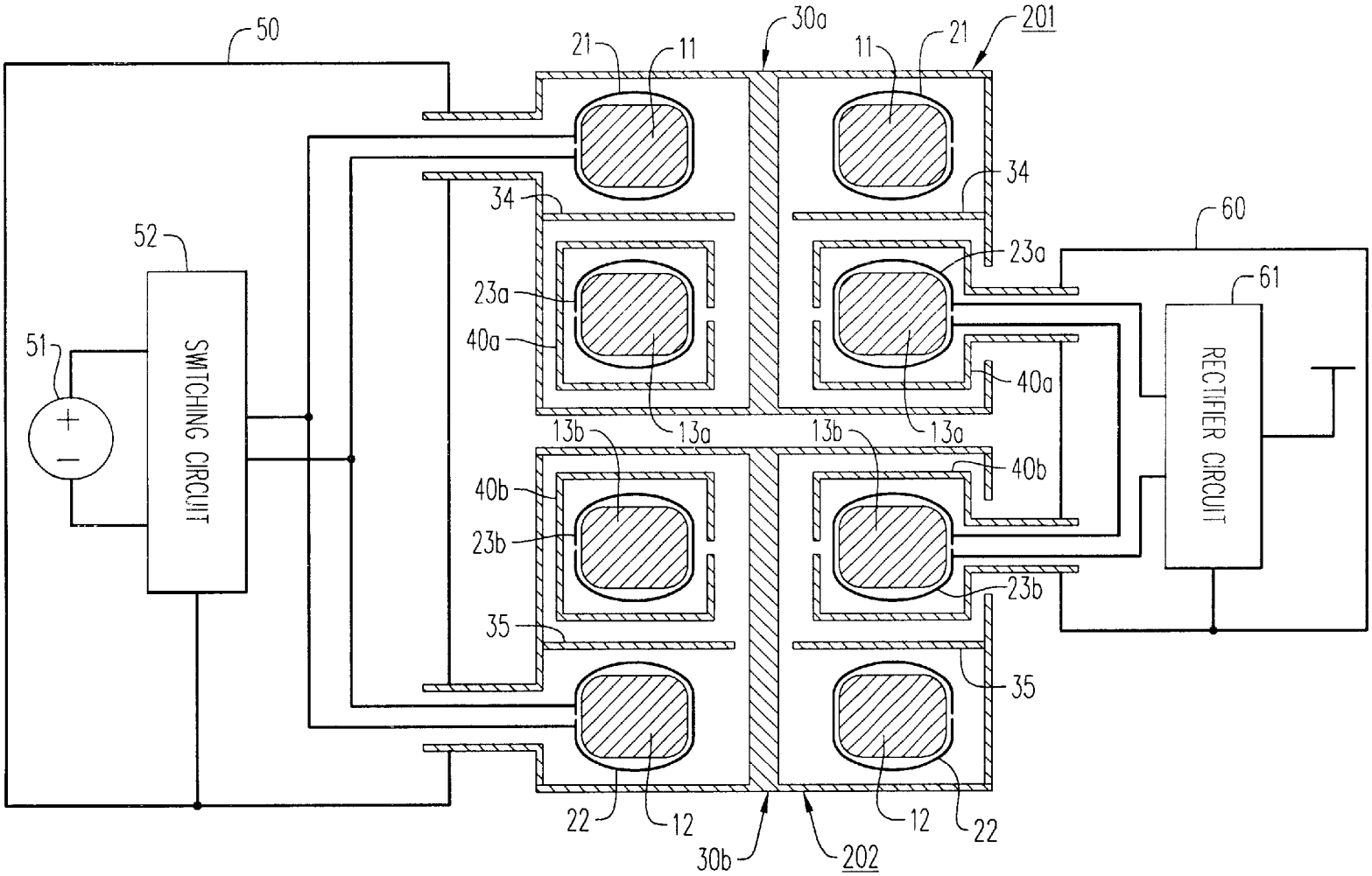
FIG. 5 shows a first modified preferred embodiment according to the present invention, and is a view combining a cross sectional view showing a transformer apparatus for use in an insulated switching power supply apparatus and a circuit diagram showing a configuration of peripheral circuits thereof.

FIG. 5 shows a first modified preferred embodiment according to the present invention, and is a view combining a cross sectional view showing a transformer apparatus used for an insulated switching power supply apparatus and a circuit diagram showing a configuration of peripheral circuits thereof. In FIG. 5, there is proposed the following modified preferred embodiment of the transformer apparatus 200 of FIG. 1, in which the secondary side core 13 is divided into two cores 13*a* and 13*b* in its thickness direction.

Referring to FIG. 5, the transformer apparatus of the present modified preferred embodiment comprises two transformers 201 and 202 which have the substantially same structure as each other. The transformer 201 comprises the core 11 around which the primary winding 21 is wound, and the core 13*a* which is entirely and electrostatically shielded by a conductor housing 40*a*, and around which a secondary winding 23*a* is wound. Further, the core 11 and the core 13*a* are arranged via the electrostatically shielding disk 34 electrically connected to the conductor housing 30*a*, are electrically connected by the conductor housing 30*a* operating as one-turn winding, and are electrostatically and magnetically shielded from the outside of the transformer apparatus by the conductor housing 30*a*. On the other hand, the transformer 202 comprises the core 12 around which the primary winding 22 is wound, and the core 13*b* which is entirely and electrostatically shielded by a conductor housing 40*b*, and around which a secondary winding 23*b* is wound. Further, the core 12 and the core 13*b* are arranged via the electrostatically shielding disk 35 electrically connected to the conductor housing 30*b*, are electrically connected by the conductor housing 30*b* operating as one-turn winding, and are electrostatically and magnetically shielded from the outside of the transformer apparatus by the conductor housing 30*b*. In this case, two secondary windings 23*a* and 23*b* are connected in series.

As described above, since symmetry is not obtained by only divided one transformer apparatus, a switching noise current flows between the primary side ground and the secondary side ground. However, use of two transformers 201 and 202 leads to that these respective transformers 201 and 202 mutually cancel the switching noise currents. Therefore, it is possible to prevent a switching noise current from flowing out to the outside of the transformers 201 and 202. Moreover, the transformer apparatus 200 is divided into two transformers 201 and 202, and this leads to that the structure of the transformer apparatus becomes simpler than that of prior art, then it becomes easy to manufacture the same transformer apparatus.

Figure 6A:
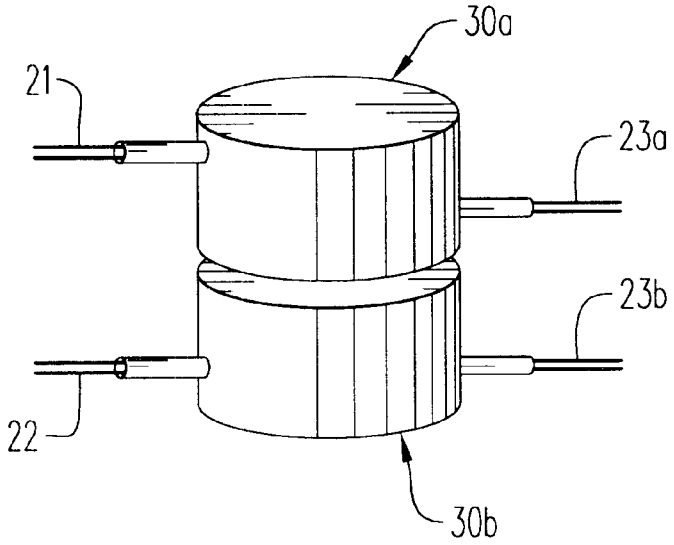
FIG. 6A is a perspective view showing a structure of the transformer apparatus of the first modified preferred embodiment of FIG. 5.
Figure 6B:
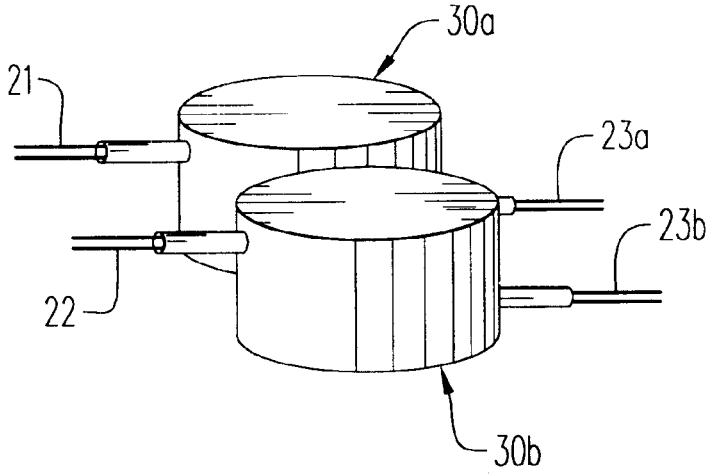
FIG. 6B is a perspective view showing a structure of a transformer apparatus of a second modified preferred embodiment.
Figure 7:
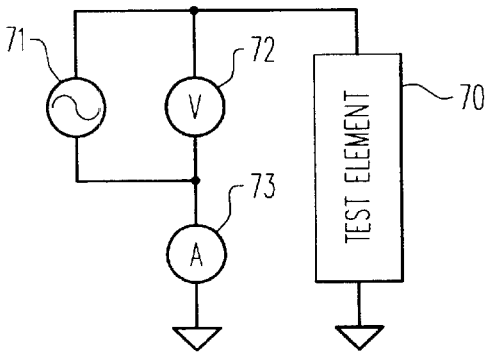
FIG. 7 (PRIOR ART)
FIG. 7 is a circuit diagram showing a configuration of a conventional impedance meter when one end of a test element is grounded.

In the first modified preferred embodiment of FIGS. 5 and 6A, two transformers 201 and 202 are laminated in a height direction, however, the present invention is not limited to this. For example, as shown in FIG. 6B, two transformers 201 and 202 may be arranged so as to be apposed with each other on a flat substrate, and this leads to that the entire height of the transformer apparatus is reduced, and therefore, it is possible to improve a degree of freedom upon mounting the transformer apparatus into various equipments.

In the above-mentioned modified preferred embodiments, the primary windings 21 and 22 are connected in parallel, and the secondary windings 23*a* and 23*b* are connected in series. The connection of these windings may be modified in accordance with an external circuit and the input and output voltages of the DC-DC converter.

EXAMPLES

Figure 9:
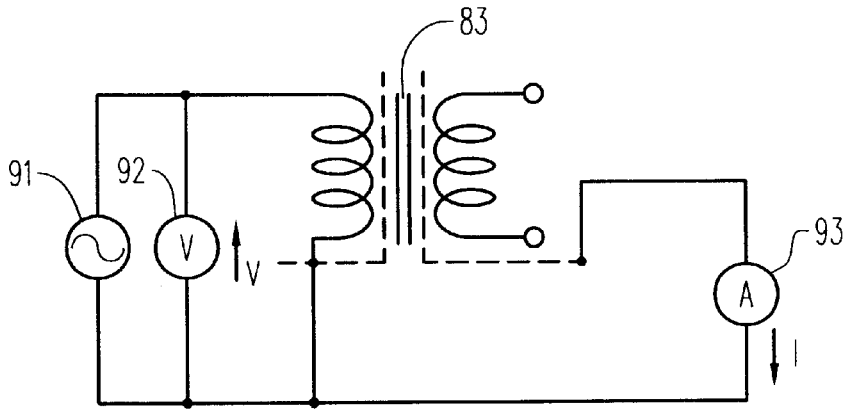
FIG. 9 (PRIOR ART)
FIG. 9 is a circuit diagram to explain an evaluation method of a conventional single transformer apparatus.
Figure 10:
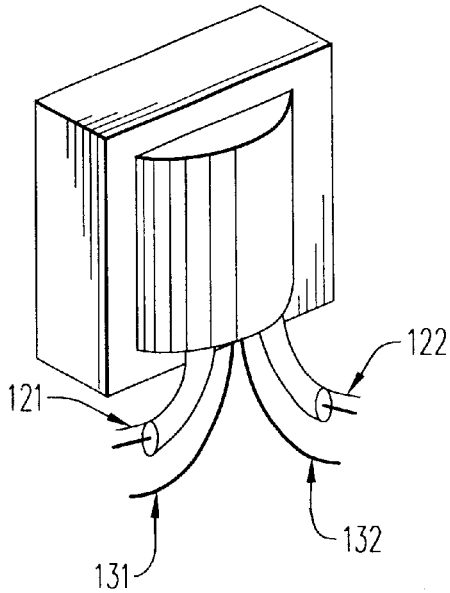
FIG. 10 (PRIOR ART)
FIG. 10 is a perspective view showing a structure of a conventional transformer apparatus.
Figure 11:
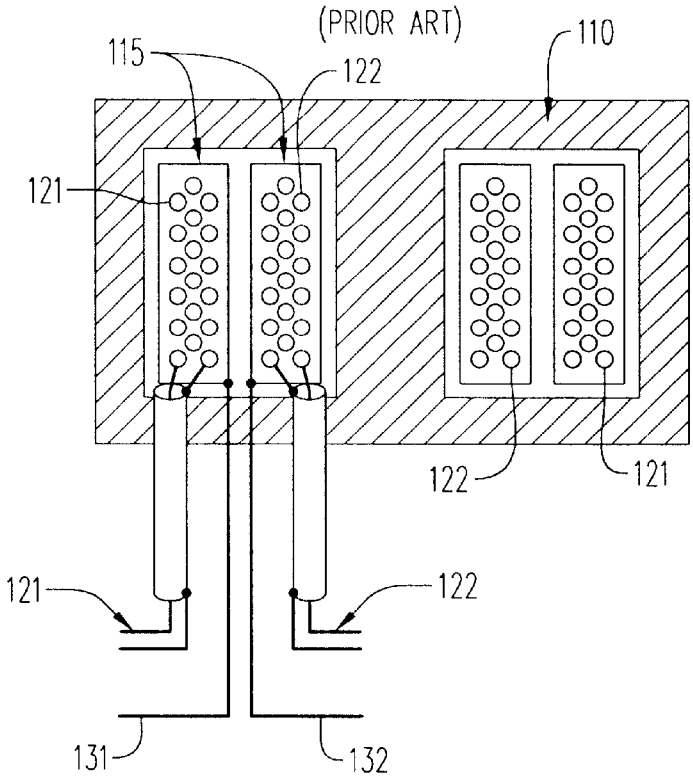
FIG. 11 (PRIOR ART)
FIG. 11 is a cross sectional view showing a structure of the conventional transformer apparatus shown in FIG. 10.
Figure 12:
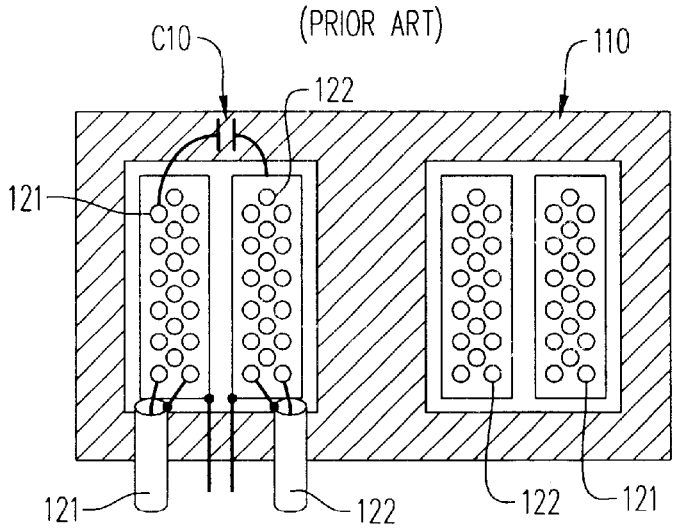
FIG. 12 (PRIOR ART)
FIG. 12 is a cross sectional view showing an electrostatic capacitance C10 between a winding and a ground shown in the cross sectional view of FIG. 11.
Figure 13:
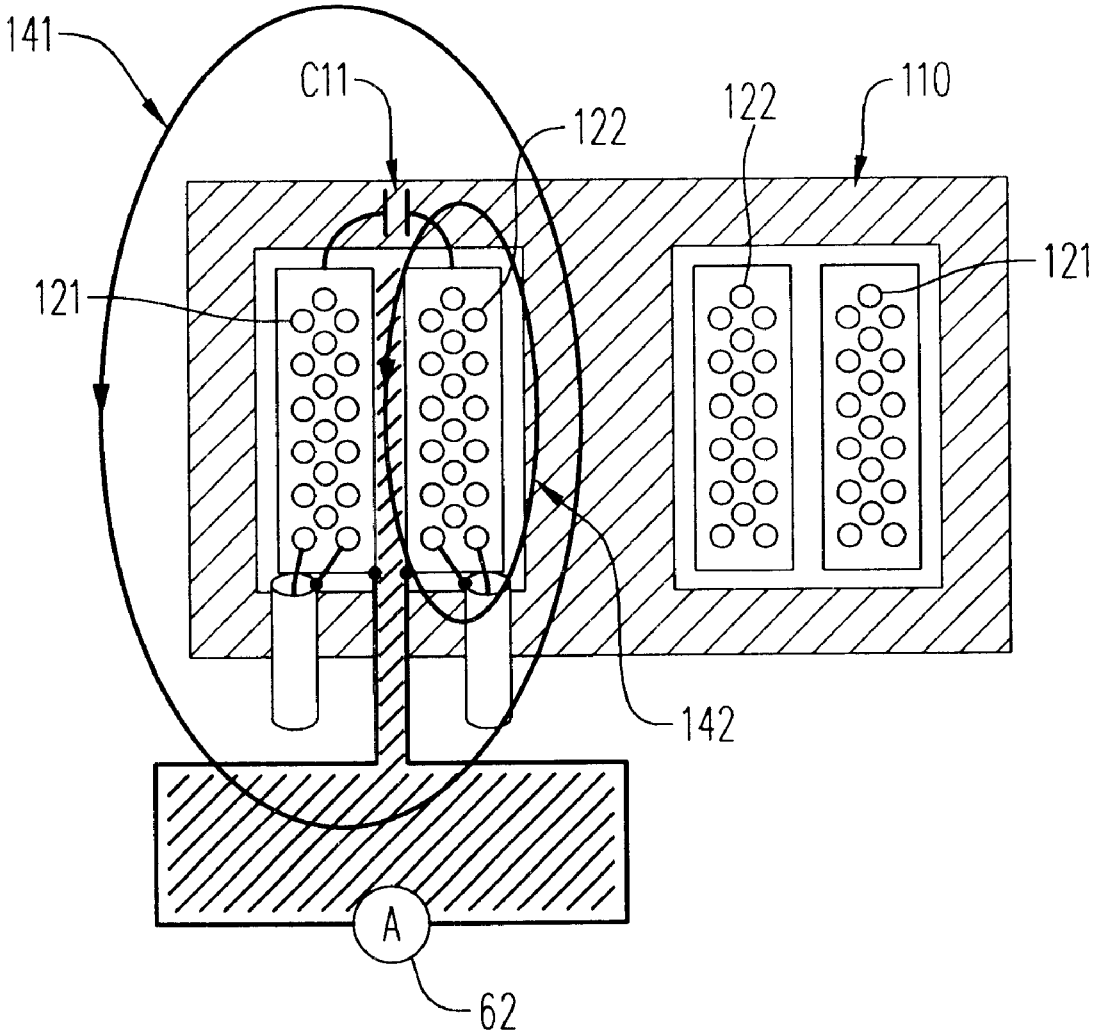
FIG. 13 (PRIOR ART)
FIG. 13 is a cross sectional view showing a leakage magnetic flux inside and outside the transformer, and an electrostatic capacitance C11 between a primary side ground and a secondary side ground shown in the cross sectional view of FIG. 11.

The capacitance value of the transformer apparatus 200 of the present preferred embodiment measured by the above evaluation method shown in FIG. 9 was 2 fF. Accordingly, the capacitance value of the transformer apparatus 200 has an improvement of 100 times as much as the conventional transformer apparatus having a capacitance value 200 fF. This leads to that it is possible to measure a minute current without any interference caused by a switching noise current of the DC-DC converter 100 in one-line ground measurement of the impedance meter.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A transformer apparatus comprising:

a first core having a first primary winding wound around said first core;

a second core having a substantially same structure as that of said first core, and having a second primary winding wound around said second core, said second primary winding being connected in parallel to said first primary winding;

a first conductor housing;

a second conductor housing; and a third core having a secondary winding around said third core, said third core being entirely and electrostatically shielded by said first conductor housing, wherein said third core is arranged so as to be sandwiched between said first and second cores respectively via first and second electrostatically shielding disks electrically connected to said second conductor housing, and wherein said first, second and third cores are electrically connected by said second conductor housing operating as one-turn winding, and are electrostatically and magnetically shielded from the outside of said transformer apparatus by said second conductor housing.

2. A transformer apparatus comprising:

first and second transformers having a substantially same structure as each other, wherein said first transformer comprises:

a first core having a first primary winding wound around said first core;

a first conductor housing;

a second conductor housing; and a third core having a first secondary winding wound around said third core, said third core being entirely and electrostatically shielded by said first conductor housing, wherein said first and third cores are arranged via a first electrostatically shielding disk electrically connected to said second conductor housing, are electrically connected by said second conductor housing operating as one-turn winding, and are electrostatically and magnetically shielded from the outside of said transformer apparatus by said second conductor housing, wherein said second transformer comprises:

a second core having a second primary winding wound around said second core, said second primary winding being connected in parallel to said first primary winding;

a third conductor housing;

a fourth conductor housing; and a fourth core having a second secondary winding wound around said fourth core, said fourth secondary winding being connected in series to said first secondary winding, said fourth core being entirely and electrostatically shielded by said third conductor housing, and wherein said second and fourth cores are arranged via a second electrostatically shielding disk electrically connected to a fourth conductor housing, are electrically connected by said fourth conductor housing operating as one-turn winding, and are electrostatically and magnetically shielded from the outside of said transformer apparatus by said fourth conductor housing.

3. The transformer apparatus as claimed in claim 2, wherein said first and second transformers are apposed with each other.

* * * * *

UNITED STATES PATENT AND TRADEMARK OFFICE

CERTIFICATE OF CORRECTION

PATENT NO. : 6,377,153 B1 
DATED : April 23, 2002
INVENTOR(S) : Haruhiko Yamanaka and Hideki Wakamatsu It is certified that error appears in the above-identified patent and that said Letters Patent is hereby corrected as shown below:

Title page,
Insert Foreign Application Priority Data,

-- [30] Aug. 31, 1999 (JP) …….. 11-245055 --

Signed and Sealed this

Twenty-ninth Day of April, 2003

JAMES E. ROGAN
*Director of the United States Patent and Trademark Office*